US005734947A

United States Patent [19]

Tanabe

[11] Patent Number: 5,734,947

[45] Date of Patent: Mar. 31, 1998

[54] METHOD AND APPARATUS FOR CONTROLLING IMAGE DENSITY FOR USE IN COPYING MACHINE

[75] Inventor: Kenichi Tanabe, Osaka, Japan

[73] Assignee: Mita Industrial Co., Ltd., Osaka, Japan

[21] Appl. No.: 678,644

[22] Filed: Jul. 11, 1996

[30] Foreign Application Priority Data

Jul. 19, 1995 [JP] Japan ..... 7-183103

[51] Int. Cl.[6] ..... G03G 15/04; G03G 15/05; G03G 15/22

[52] U.S. Cl. ..... 399/45; 399/46; 399/55

[58] Field of Search ..... 399/45, 46, 50, 399/51, 55, 82, 83, 85, 9, 15

[56] References Cited

U.S. PATENT DOCUMENTS

| | | | |
|---|---|---|---|
| 5,206,686 | 4/1993 | Fukui et al. | 355/208 |
| 5,282,000 | 1/1994 | Miyake et al. | 355/208 |
| 5,294,959 | 3/1994 | Nagao et al. | 355/208 |
| 5,303,006 | 4/1994 | Mizude | 355/208 |
| 5,400,120 | 3/1995 | Narazaki et al. | 355/208 |
| 5,455,657 | 10/1995 | Takeda | 355/208 |
| 5,499,079 | 3/1996 | Kinoshita et al. | 355/208 |

*Primary Examiner*—R. L. Moses

*Attorney, Agent, or Firm*—Beveridge, DeGrandi, Weilacher & Young, LLP

[57] ABSTRACT

A method and apparatus for controlling the image density of a copy of a special document original with a large image density variation. When a special document original is to be copied, the surface potential of a photoreceptor is set to a level lower by a predetermined value than that employed for an ordinary document original copying operation. Thus, the image density of the resulting copy is comprehensively reduced, and the image density variation in the copy is moderated. Further, the amount of light emitted from the light source for illumination of the document original is set to a predetermined level adapted for a low density document original. Thus, the image density of the copy is prevented from being reduced too much. The level of development bias to be applied to a developing unit corresponding to at least a predetermined standard density level is set to a level higher by a predetermined value than that employed for an ordinary document original copying operation. Thus, the fogging of the resulting copy image can be suppressed.

9 Claims, 7 Drawing Sheets

METHOD AND APPARATUS FOR CONTROLLING IMAGE DENSITY FOR USE IN COPYING MACHINE

BACKGROUND OF THE INVENTION

1. Field of the Invention

The present invention relates to a method and apparatus for controlling an image density for use in a copying machine. More particularly, the invention relates to a method and apparatus for controlling the density of a copy image to be formed by a copying machine so as to properly reproduce an original image including a high image density portion and a low image density portion.

2. Description of Related Art

Conventionally, electrophotographic copying machines are widely used which make copies of a document original on the basis of an electrophotographic process. In a copying machine of this type, a copy image of a document original is formed in the following manner. The document original is optically scanned, and a photoreceptor of the copying machine is exposed to light reflected from the document original. The light reflected from the document original selectively removes electrostatic charge from the surface of the photoreceptor which is uniformly pre-charged, whereby an electrostatic latent image corresponding to an original image of the document original is formed on the surface of the photoreceptor. The latent image is developed into a toner image by an operation of a developing unit which has a development roller brought in contact with the photoreceptor. Then, the toner image is transferred onto a transfer sheet, and the transferred toner image is fixed on the transfer sheet by applying thereto heat and pressure by means of a fixing unit.

In general, such a copying machine includes a density controlling key for controlling the density of a copy image. This is because there are various kinds of document originals including a standard document bearing black characters printed on a high-quality paper sheet, printed matter such as a newspaper whose background is not pure white, and a mother print bearing an image printed on a translucent paper sheet. By properly controlling the copy density on the basis of the kind of a document original to be copied, an excellent copy can be obtained from any of various kinds of document originals.

The control of the copy density is achieved by variably setting the amount of light emitted from a light source for illumination of the document original and/or development bias applied to the development roller. More specifically, by increasing the amount of light for illumination of the document original, the light exposure of the photoreceptor is increased, so that the copy density is lowered. By decreasing the development bias, the potential difference between the photoreceptor and the development roller is increased, so that a larger amount of toner adheres onto the surface of the photoreceptor to increase the copy density.

Document originals to be copied by the copying machine do not necessarily have a uniform image density on the entire document surfaces thereof. A document original bearing characters and an illustration formed thereon, for example, includes a relatively low image density area with thin lines and an extremely high image density area with a solidly shaded portion. If the copy density is controlled in adaptation to the solidly shaded portion when such a document original is to be copied, the characters of thin lines may be missing in the resulting copy image. That is, the characters cannot be reproduced at all though the solidly shaded portion can be properly reproduced. Therefore, the copy density is generally controlled in adaptation to a lower image density area such as a character-bearing portion. However, the image density control in adaptation to the lower image density area may result in an image defect such as so-called "front trailing" or "tail trailing" (disfigurement in a linear configuration extending from a solidly shaded portion of the resulting copy image in the background thereof).

Such an image defect may appear not only when a document original is copied which includes areas of two image density levels, but also when a document original is copied which includes areas of three or more image density levels, for example, a low image density area with thin lines, an intermediate image density area with ordinary characters and a high image density area with a solidly shaded portion. If the front trailing or tail trailing appears in an intermediate image density area of the resulting copy image, there is a possibility that characters in the copy image become illegible.

SUMMARY OF THE INVENTION

It is therefore an object of the present invention to provide a method and apparatus for controlling the density of a copy image to be formed by a copying machine so as to properly reproduce an original image including areas of different image density levels.

It is another object of the present invention to provide a copying machine which is capable of properly reproducing an original image including areas of different image density levels.

In accordance with the present invention, when a special document original with a relatively large image density variation is to be copied, the surface potential of a photoreceptor is adjusted to a level lower by a predetermined value than that to be employed for an ordinary document original copying operation. Thus, the density of the resulting copy image is comprehensively reduced, and the image density variation in the copy image is reduced. Thus, image defects such as so-called front trailing and tail trailing can be prevented from appearing around a high image density area in the copy image. Further, the amount of light emitted from a light source for illumination of the document original is adjusted to a predetermined level adapted for a low image density area of the document original. Thus, the density of the copy image is prevented from being reduced too much.

When a special document original is to be copied, development bias to be applied to a developing unit, in adaptation to at least a predetermined standard image density level, is preferably adjusted to a level higher by a predetermined value than that to be employed for the ordinary document original copying operation. If the light amount is set in adaptation to the low image density area of the document original, the fogging of the copy image may result. By adjusting the development bias to a level higher by a predetermined value than that to be employed for the ordinary document original copying operation, the fogging of the copy image can be suppressed.

Where the development bias can be set to a level adapted for any one of a plurality of image density levels including the aforesaid standard image density level for variable adjustment thereof, the levels of the development bias corresponding to the respective image density levels are preferably determined such that the rate of a change in the development bias with respect to the change in the image density level is smaller than that for the ordinary document original copying operation.

In this case, fine adjustment of the image density can be achieved by the variable adjustment of the development bias levels. In addition, since the rate of the change in the development bias with respect to the change in the image density level is smaller than that for the ordinary document original copying operation, fine adjustment of the development bias can be facilitated. Therefore, an excellent copy of the special document original can be readily obtained.

Further, it is preferred that each of the development bias levels corresponding to the respective image density levels can be shifted by an equal bias amount. When the special document original cannot properly be copied by changing the image density level, for example, the development bias levels corresponding to the respective image density levels are all shifted. Thereafter, the development bias can be adjusted by changing the image density level to obtain an excellent copy of the special document original.

The foregoing and other objects, features and advantages of the present invention will become apparent from the following description of the preferred embodiments with reference to the attached drawings.

DESCRIPTION OF THE PREFERRED EMBODIMENTS

Figure 1:
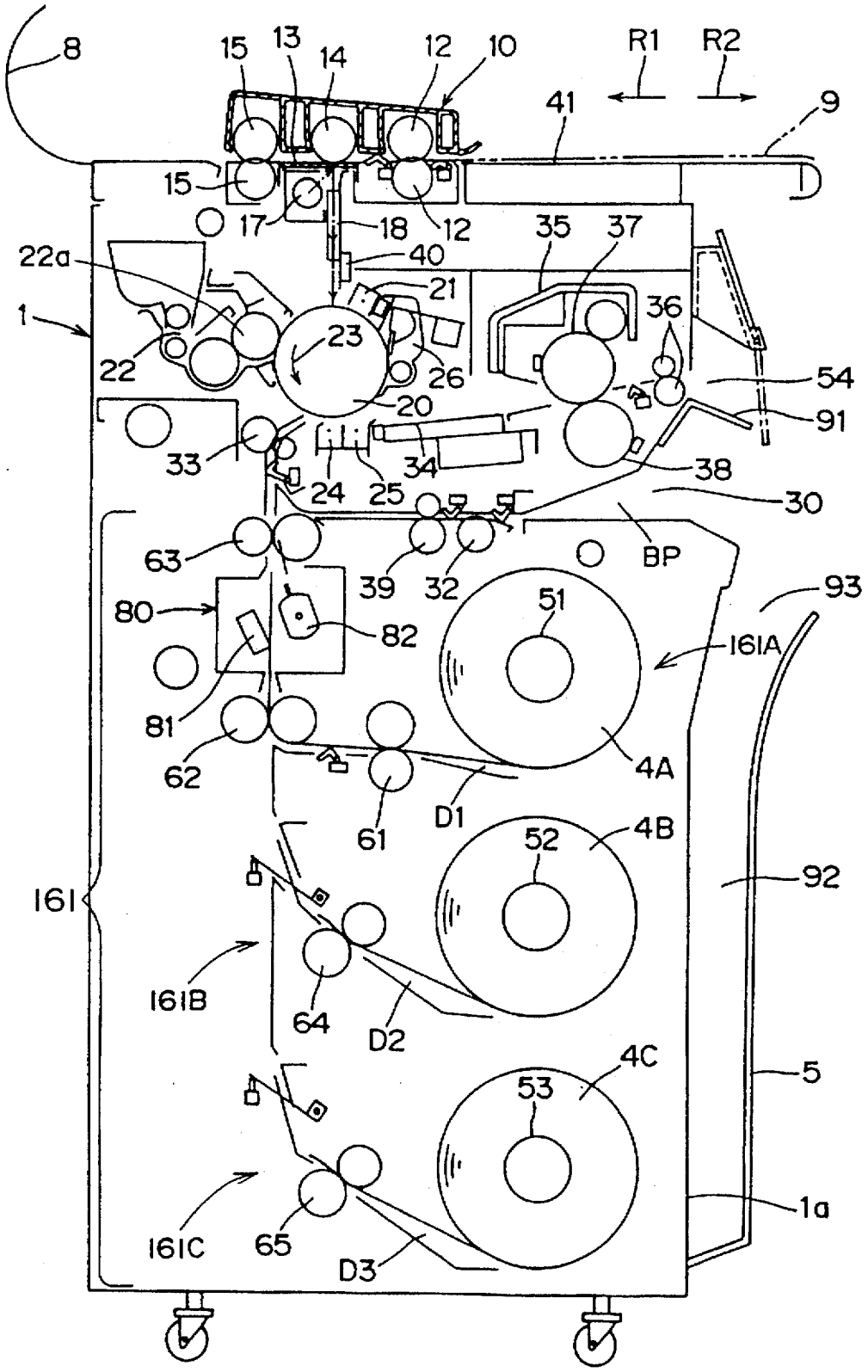
FIG. 1 is a schematic sectional view illustrating the internal construction of a copying machine to which one embodiment of the present invention is applied.
Figure 2:
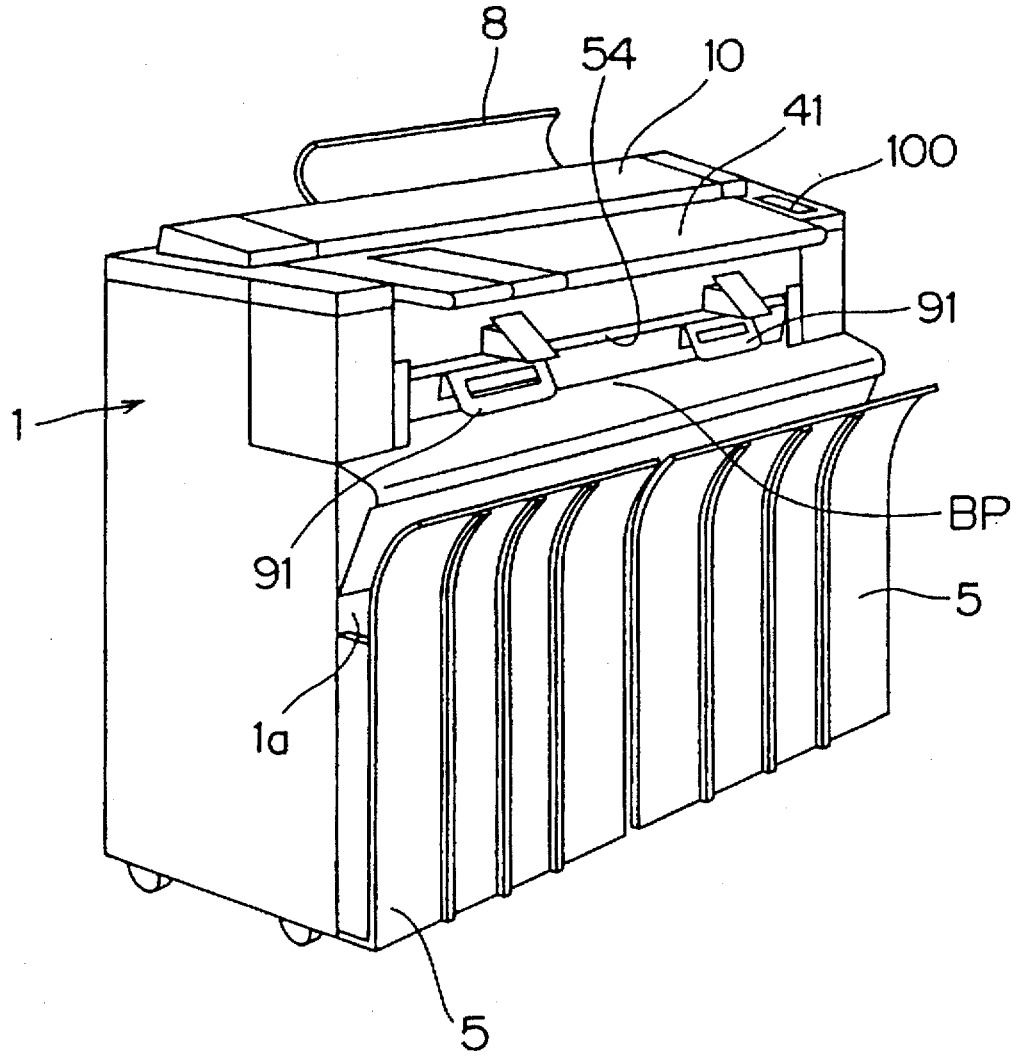
FIG. 2 is a perspective view illustrating the exterior construction of the copying machine.

FIG. 1 is a schematic sectional view illustrating the internal construction of an electrophotographic copying machine to which one embodiment of the present invention is applied. FIG. 2 is a perspective view illustrating the exterior construction of the copying machine. The copying machine is adapted, for example, to make a copy of a large-size document original such as of A0 size (841 mm×1189 mm). In the copying machine, a document surface of a document original being transported is illuminated to be scanned by a stationary optical system, and an image is formed on the basis of the scanning.

On the top face of a main body 1 of the copying machine is provided an operation section 100 for making various settings related to a copying operation and a document-original transportation path 41 for transporting a document original 9 therealong. A document-original transportation section 10 for transporting the document original 9 is disposed on the top face of the main body 1 in association with the document-original transportation path 41. A discharge port 54 for discharging a sheet having a toner image transferred thereon opens in a front face 1*a* of the main body 1. The sheet discharged from the discharge port 54 is guided by a guide member 91, dropped through a guide opening 93 with the leading edge thereof oriented downward, and accommodated in a pocket 92 defined by a front cover 5 provided along the front face 1*a* of the main body 1.

The document-original transportation section 10 transports the document original 9 in a regular direction R1 and in a reverse direction R2. The image forming operation is performed in synchronization with the transportation of the document original 9 in the regular direction R1. When a plurality of copies are made from a single document original, the document-original transportation section 10 alternates the regular transportation direction R1 and the reverse transportation direction R2 for the transportation of the document original 9. A reference numeral 8 denotes a reversion member for preventing the document original 9 from dropping to the rear side of the main body 1 by reversing the transportation direction of the document original.

The document-original transportation section 10 has first transportation rollers 12, a second transportation roller 14 and third transportation rollers 15 arranged along the regular transportation direction R1 in this order. The second transportation roller 14 faces opposite a transparent plate 13 for exposing the document original 9 to slit light and serves to press the document original 9 against the transparent plate 13.

A stationary light source 17 for illuminating the document surface of the document original 9 for the scanning thereof is disposed in association with the transparent plate 13. The light source 17 includes a fluorescent lamp, for example. The document surface is irradiated with light from the light source 17 through the transparent plate 13. Light reflected from the surface of the document original 9 is led to the surface of a photoreceptor drum 20 disposed inside the main body 1 by means of a selfoc lens 18. Before being exposed to the light from the selfoc lens 18, the surface of the photoreceptor 20 is uniformly charged by a corona discharger 21 for electrostatic charging. An electrostatic latent image corresponding to a document original image is formed on the surface of the photoreceptor 20 by selectively removing the electrostatic charge from the photoreceptor surface by the light exposure. A surface potentiometer 40 for measuring the surface potential of the photoreceptor 20 is disposed in the vicinity of the selfoc lens 18.

The electrostatic latent image formed on the surface of the photoreceptor 20 is developed into a toner image by a developing unit 22 disposed adjacent the photoreceptor 20 and having a development roller 22*a*. The toner image formed on the photoreceptor 20 is brought into the vicinity of a corona discharger 24 for image transfer, as the photoreceptor 20 is rotated in a direction indicated by an arrow 23. A copy sheet is fed from a sheet feeding section 161 between the corona discharger 24 for image transfer and the photoreceptor 20. The toner image formed on the surface of the photoreceptor 20 is transferred onto the copy sheet by the operation of the corona discharger 24 for image transfer. After the toner image is transferred, the surface of the photoreceptor 20 is cleaned by a cleaning unit 26 for the next copying operation.

On the other hand, the copy sheet having the toner image transferred thereon is removed from the surface of the photoreceptor 20 by the operation of a corona discharger 25 for sheet removal, and then led to a fixing unit 35 through a transportation path 34. In the fixing unit 35, toner is fixed onto the surface of the copy sheet by heat-pressing the copy sheet between a pair of rollers 37 and 38. After the fixation, the copy sheet is guided by discharge rollers 36 and discharged out of the main body 1 from a port 54.

The sheet feeding section 161 includes upper, middle and lower sheet feeding units 161A, 161B and 161C located between a vertically middle portion and a lower portion in the main body 1. The sheet feeding units 161A, 161B and 161C respectively accommodate roll sheets 4A, 4B and 4C which are wound around sheet feeding reels 51, 52 and 53 into roll bodies. Examples of sheets to be used as the roll sheets 4A, 4B and 4C include normal paper, transparent film and tracing paper.

In the central portion of the main body 1 is disposed a bypass sheet feeding path BP for feeding a cut-sheet preliminarily cut into a predetermined size such as of A1 size to A4 size through a manual sheet-feeding section 30 provided on the front face 1*a* of the main body 1. In association with the bypass transportation path BP is disposed transportation rollers 32 and 39 for guiding the sheet to registration rollers 33 disposed just before the photoreceptor 20. The registration rollers 33 feed the sheet to the photoreceptor 20 in synchronization with the rotation of the photoreceptor 20.

The upper sheet feeding unit 161A has sheet feeding rollers 61 for paying out the roll sheet 4A therefrom, transportation rollers 62 for guiding the paid-out sheet upward, a cutter mechanism 80 for cutting the sheet, and transportation rollers 63 for guiding the sheet to the registration rollers 33. The cutter mechanism 80 includes an elongated stationary blade 81 and a rotary blade 82 cooperating with the stationary blade 81 to cut the sheet therebetween.

The middle and lower sheet feeding units 161B and 161C have sheet feeding rollers 64 and 65 for paying out therefrom the roll sheets 4A and 4B, respectively. The sheet paid out by the sheet feeding rollers 64 or 65 is guided to the registration rollers 33 through the transportation rollers 62, the cutter mechanism 80 and the transportation rollers 63.

Figure 3:
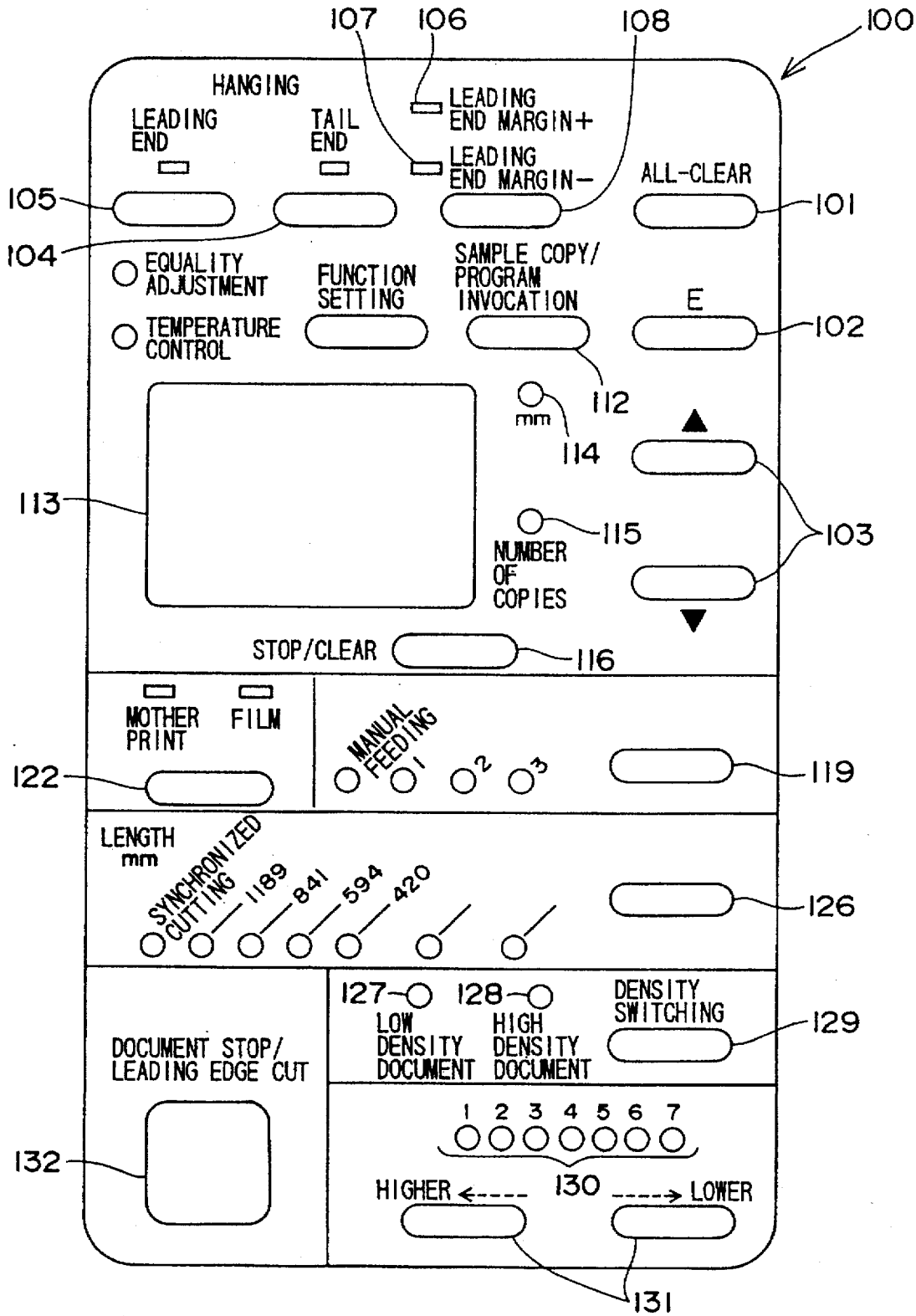
FIG. 3 is a plan view for explaining the construction of an operation section of the copying machine.

FIG. 3 is a plan view for explaining the construction of the operation section 100 provided on the top face of the copying machine. The operation section 100 includes an all-clear key 101 for resetting all the settings, an enter key 102 for enabling a selected function, up/down keys 103 for setting the number of copies or the like, a tail end hanging key 104 for providing a tail end margin, a leading end hanging key 105 for providing a leading end margin, a leading end margin key 108 for making a copy with a leading end margin, a sample copy/program invocation key 112 for making a sample copy or displaying a message for invocation of a preliminarily programmed copying procedure, a stop/clear key 116 for resetting a copy number to "1" or interrupting the copying operation, a copy sheet selection key 119 for selecting a roll sheet unit or manual sheet feeding, a special sheet selection key 122 operated when a copy is to be made on a special sheet such as of a mother print (translucent paper) or film, a sheet length selection key 126 for setting the length of a roll sheet to be cut, a document original image density switching key 129 for selecting an image density level of a document original, copy density controlling keys 131 for controlling a copy density, and document original stop/leading edge cut key 132 operated when the copying operation is to be interrupted or a leading edge portion of a roll sheet is cut after the roll sheet is set in position.

The operation section 100 further includes leading end margin indicators 106 and 107 for indicating whether the value of the leading end margin is positive or negative, a message display portion 113 for displaying the number of copies, the length of a roll sheet to be cut and the operating conditions of the machine, a length indicator 114 which is to be lit when a specified roll sheet length is displayed in the message display portion 113, a copy number indicator 115 which is to be lit when the number of copies is displayed in the message display portion 113, a low density document original indicator 127 which is to be lit when a density level for a low image density document original is selected by pressing the document original image density switching key 129, a high density document original indicator 128 which is to be lit when a density level for a high image density document original is selected by pressing the key 129, and a copy density indicator 130 for indicating the copy density in 13 levels between "1" to "7" at an interval of 0.5.

The copy density indicator 130 includes seven LEDs (light emitting diodes). When only the leftmost LED is lit, the copy density level is "1" (the highest density). When only the rightmost LED is lit, the copy density level is "7" (the lowest density). The copy density level is indicated by the lighting of one LED or a pair of adjacent LEDs. For example, the lighting of only the second LED from the left indicates a density level of "2", and the lighting of the first and second LEDs from the left indicates a density level of "1.5".

When a copying operation is to be performed, an operator operates the keys with reference to information displayed in the message display portion 113. For example, the operator operates the up/down keys 103 to set the number of copies to be made, and operates the document original image density switching key 129 to select a density level corresponding to the image density of a document original. When the operator thereafter sets a document original 9 in the document original transportation path 41, the copying operation is started. If the image density of the resulting copy is too high or too low, the copy density controlling key 131 is operated to control the copy density, the level of which is indicated by the copy density indicator 130. At this state, the copying operation is performed again. The copy density controlling key 131 corresponds to density control input means.

Figure 4:
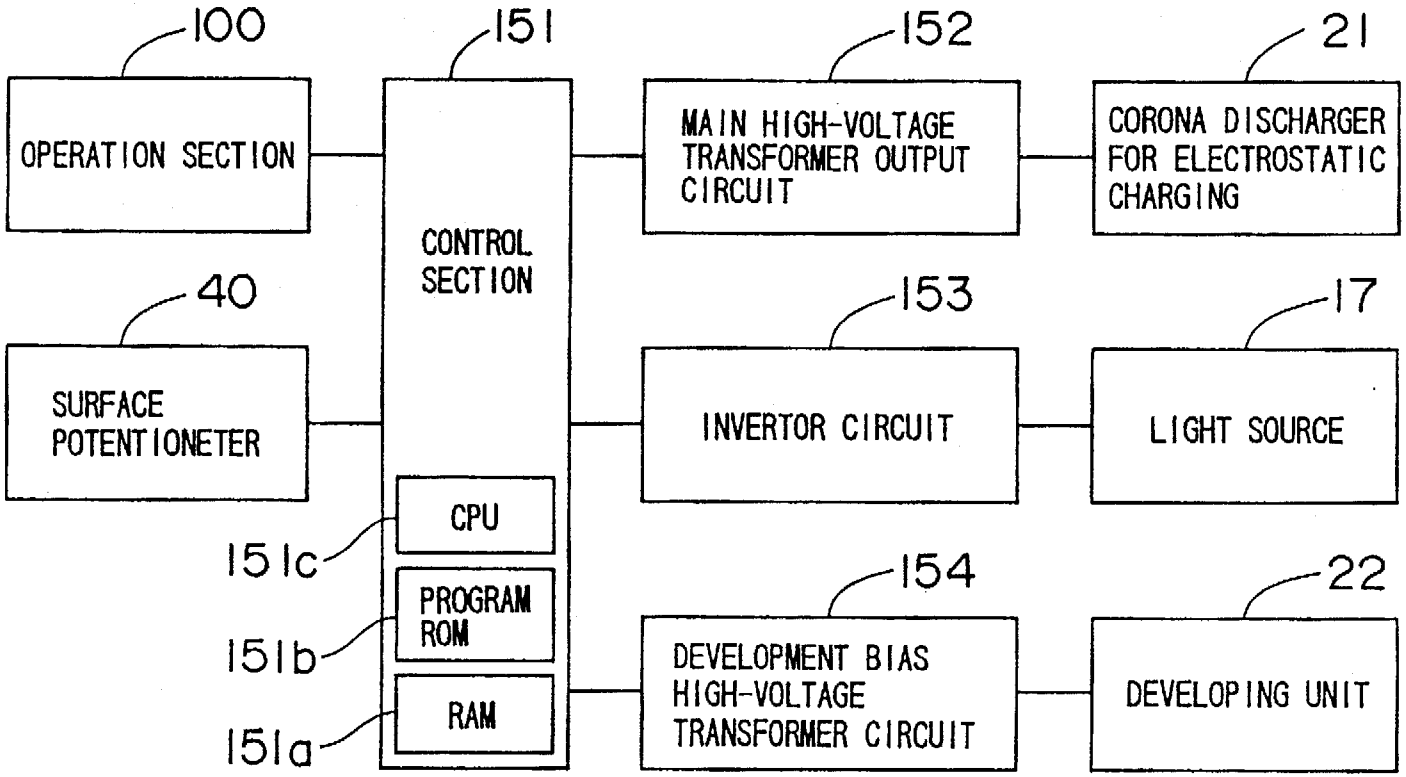
FIG. 4 is a block diagram illustrating the electrical construction of the copying machine related to an image density controlling operation.

FIG. 4 is a block diagram illustrating the electrical construction of the copying machine related to an image density controlling operation. A control section 151 for controlling the operations of respective components of the copying machine functions as surface potential controlling means, light amount controlling means, development bias controlling means and the like, and includes a microprocessor having a RAM 151*a*, a program ROM 151*b* and a CPU (central processing unit) 151*c*. The control section 151 receives signals outputted from the operation section 100 and the surface potentiometer 40. The control section 151 operates in accordance with a program stored in the program ROM 151*c* on the basis of the signals from the operation section 100 and the surface potentiometer 40 to control a main high-voltage transformer output circuit 152, an invertor circuit 153, and a development bias high-voltage transformer circuit 154. The main high-voltage transformer output circuit 152 serves to apply a high voltage to the corona discharger 21 for electrostatic charging. The invertor circuit 153 serves to supply power to the light source 17 of a fluorescent lamp. The development bias high-voltage transformer circuit 154 serves to apply development bias to the development roller 22*a*.

The surface potential of the photoreceptor 20 can be controlled by controlling the main high-voltage transformer output circuit 152. By controlling the invertor circuit 153, the light amount of the light source 17 can be controlled to control the light exposure of the photoreceptor 20. Further, the development bias can be controlled by controlling the development bias high-voltage transformer circuit 154.

Figure 5:
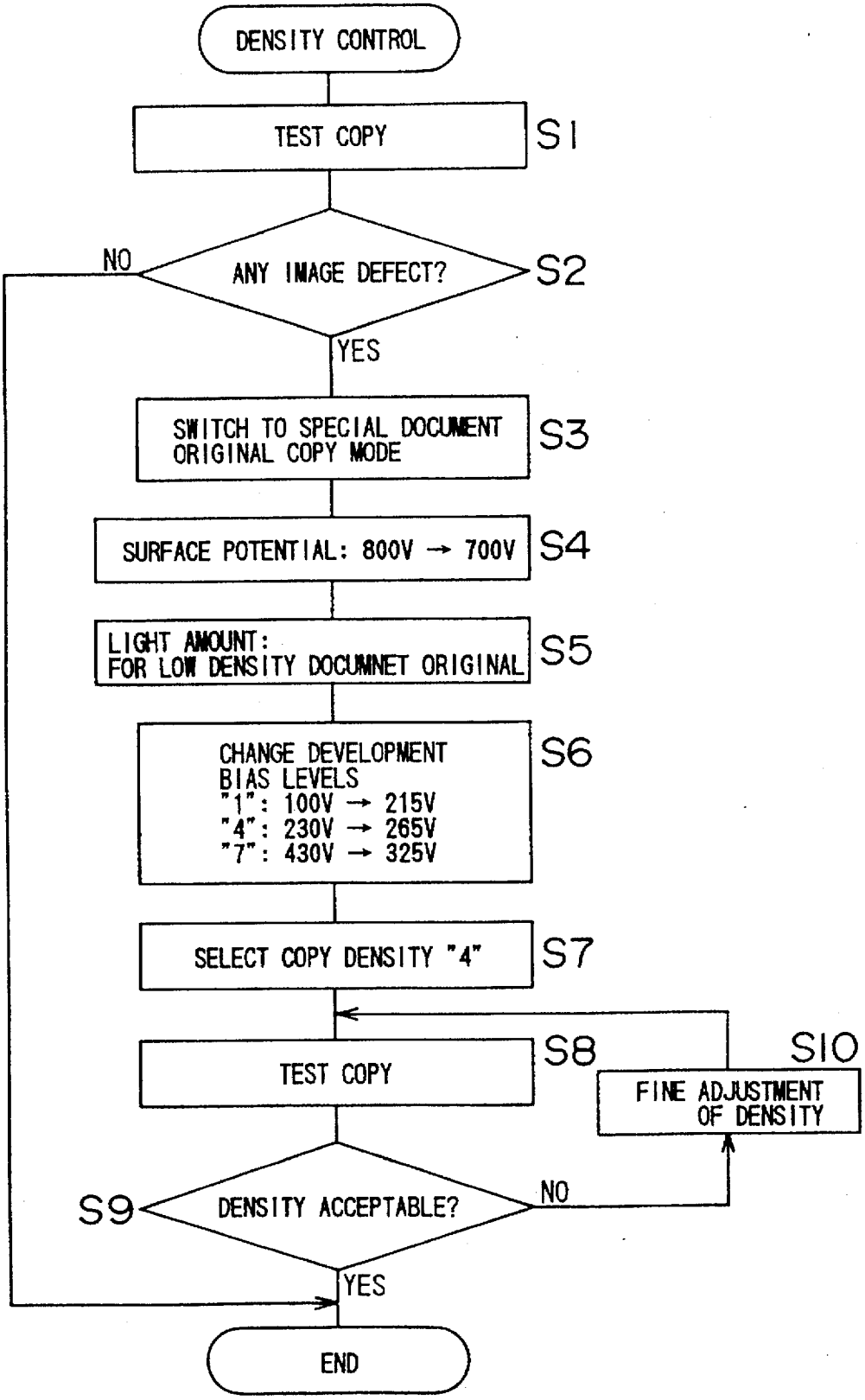
FIG. 5 is a flow chart for explaining the process flow of the image density controlling operation in the copying machine.

FIG. 5 is a flow chart for explaining the process flow of an operation to be performed when a special document original with a locally nonuniform image density is to be copied. The process shown in FIG. 5 is effective for copying a document original having both a character area and an illustration area.

In order to prevent lower density portions of a document original from being missing in a copy image, an operator first operates the density switching key 129 to light the low density document original indicator 127. When the operator sets the document original of interest in the document original transportation path 41, the document original transportation section 10 starts the transportation of the document original for a copying operation. Thus, a test copy is made (Step S1).

Then, the operator visually inspects the resulting copy (Step S2). If the copy has no image defect, the copy can serve for an operator's purpose without any additional operation. To make a plurality of copies from that document original, the operator operates the up/down keys 103 to input the number of copies to be made, and then resets the document original.

If the copy has any image defect, the process flow returns to Step S3. More specifically, if a so-called front trailing or tail trailing appears around a relatively high image density portion of the resulting copy, the operation mode is switched from an ordinary copy mode to a special document original copy mode. The special document original copy mode is adapted to properly reproduce a document original with a locally nonuniform image density. The switching of the operation mode is achieved by continuously pressing the density switching key 129 for more than a predetermined time period (e.g., more than 6 seconds). The control section 151, which detects the density switching key 129 being continuously pressed for more than the predetermine time period, changes controlling conditions of the main transformer output circuit 152, the invertor circuit 153 and the development bias high-voltage transformer circuit 154.

More specifically, the surface potential of the photoreceptor 20 is reduced, for example, by 100V (Step S4). The control section 151 can change the surface potential of the photoreceptor 20 by a degree within a range of 130V, for example. The lowering of the surface potential by 100V is achieved simply by controlling the main high-voltage transformer output circuit 152 by means of the control section 151. The control section 151 usually controls the main high-voltage transformer output circuit 152 on the basis of an output of the surface potentiometer 40 to adjust the surface potential of the photoreceptor 20 to 800V, for example. Accordingly, the surface potential of the photoreceptor 20 is adjusted to 700V in Step S4.

Figure 6:
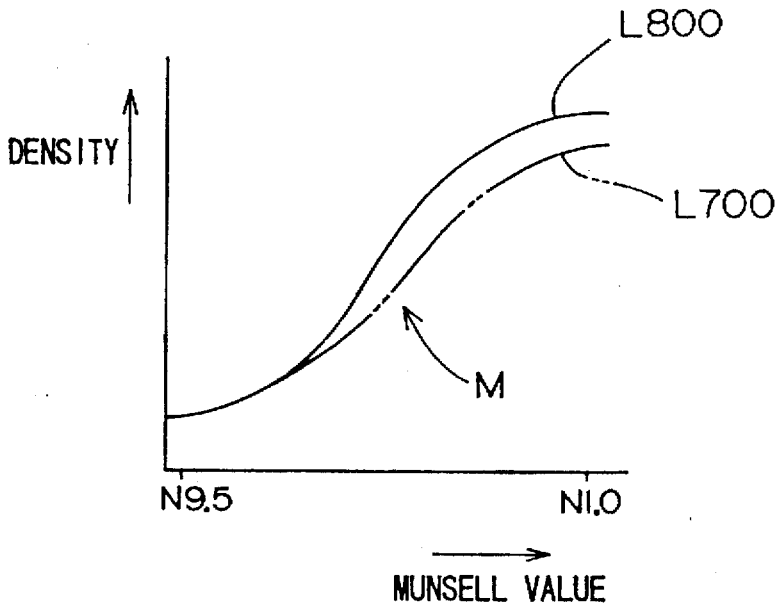
FIG. 6 is a graphical representation illustrating characteristic curves of the Munsell value versus the image density obtained at surface potentials of 700V and 800V, respectively.

The reduction of the surface potential by 100V influences the copy density as shown in FIG. 6, which illustrates the copy image density obtained when test document originals having Munsell values between N9.5 and N1.0 are copied. Curves L800 and L700 represent image density characteristics obtained at surface potentials of 800V and 700V, respectively. The comparison of the curves L800 and L700 indicates that, when a high image density document original is copied at a reduced surface potential of the photoreceptor, the image density of the resulting copy is lowered. The comparison further shows that the slope of a characteristic curve within an intermediate image density range is moderated by reducing the surface potential by 100V as indicated by a reference character M in FIG. 6. Thus, the image density variation in the resulting copy is somewhat alleviated.

Referring again to FIG. 5, after the surface potential is reduced, the control section 151 controls the invertor circuit 153 to adjust the light amount of the light source 17 to a level adapted for a low density document original (Step S5). That is, the light exposure of the photoreceptor is reduced.

Where the light source 17 includes a fluorescent lamp, for example, the light amount of the fluorescent lamp can be selected from the following three levels.

28,000 Lux: Light amount level adapted for a high image density document original such as a newspaper.

20,000 Lux: Light amount level adapted for an ordinary document original.

8,000 Lux: Light amount level adapted for a low image density document original such as a section document.

It should be noted that these luminous intensities are measured on the transparent plate 13 through a green filter.

The light amount level adapted for a low image density document original is such that an image of blue lines on graph paper can be clearly reproduced in a copy. When this light amount level is selected, the density of the entire copy image can be increased. There is a tendency that the density of the entire copy image is reduced too much when the surface potential is reduced by 100V. Therefore, the density of the entire copy image is increased by reducing the light exposure.

However, the reduced light exposure may result in a foggy copy image. To prevent this, the development bias is changed (Step S6). More specifically, the level of the development bias corresponding to a density level "1" is raised from 100V (an ordinary development bias level employed for an ordinary document original copying operation) to 215V. The level of the development bias corresponding to a density level "4" is raised from an ordinary level of 230V to 265V. Further, the level of the development bias corresponding to a density level "7" is lowered from an ordinary level of 430V to 325V. The levels of the development bias corresponding to density levels other than "1", "4" and "7" are determined by linear interpolation. Thus, the rate of the change in the development bias with respect to the change in the density level is reduced. In other words, the gradient of the development bias is moderated. The levels of the development bias corresponding to the respective density levels are determined by the control section 151 which also functions as bias gradient changing means.

For a default density level "4" (which is defined as the standard density level), the development bias is increased by 30V. Therefore, the potential difference between the photoreceptor 20 and the development roller **22*a* is smaller than that before the development bias is changed. Therefore, the amount of toner adhering to the photoreceptor 20** can be reduced, thereby preventing the fogging of the resulting copy image which may otherwise occur due to the reduced light exposure.

In turn, the operator resets the document original in the document original transportation path 41, and selects the default copy density level "4" (Step S7). Then, the operator carries out the test copying operation (Step S8). The operator visually inspects the resulting copy to determine whether the copy is acceptable or not (Step S9). If the image density of the copy is acceptable, the copy density adjusting operation is completed. If the image density of the copy is too high or too low, the operator operates the copy density controlling key 131 to make fine adjustment (Step S10). Then, the operator carries out the test copying operation again (Step S8).

As described above, the gradient of the development bias is significantly moderated in comparison with the ordinary document original copying operation. Therefore, the fine adjustment of the development bias can be performed by operating the copy density controlling key 131. Thus, the optimum development bias can be precisely selected, thereby making it possible to provide a copy of the document original with its original image density reproduced with high fidelity.

The operation mode can be reset from the special document original copying mode to the ordinary mode, for example, by operating the all-clear key 101.

The levels of the development bias for a low image density document original corresponding to density levels "1", "4" and "7" are adjusted, for example, to 300V, 400V and 500V, respectively. Where these development bias levels for a low image density document original are employed to copy a document original with a large image density variation, however, it may be impossible to make a fine adjustment of the copy density because the rate of a change in the development bias with respect to the change in the density level is too large.

Figure 7:
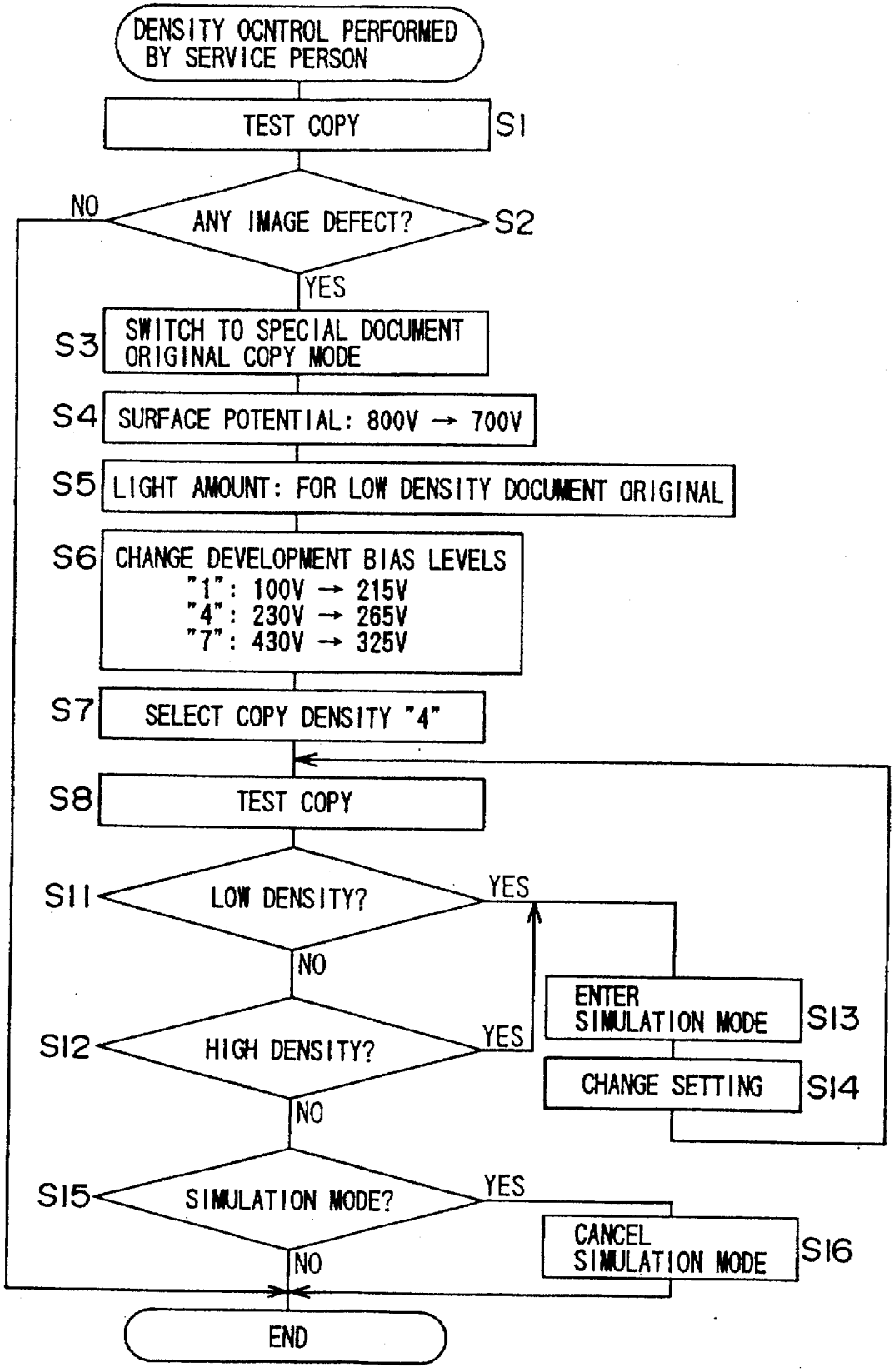
FIG. 7 is a flow chart for explaining the process flow of an image density controlling operation to be performed by a service person.

FIG. 7 is a flow chart for explaining the process flow of an image density controlling operation to be performed by a service person when a document original including a high image density area and a low image density area cannot properly be copied. In FIG. 7, a like step number designates a like process or operation as explained with reference to FIG. 5.

The service person adjusts the development bias in the special document original copy mode. More specifically, after a test copying operation is performed at the density level "4" in Step S8, the service person determines whether the image density of the resulting copy is too low (Step S11) and/or whether the image density of the resulting copy is too high (Step S12). That is, the service person judges whether the image density of the resulting copy is acceptable. If the image density of the copy is unacceptable, the service person performs an operation to let the copying machine into a simulation mode (Step S13).

The copying machine may be put in the simulation mode, for example, by turning off and on a power switch (not shown) while simultaneously pressing the stop/clear key 116 and the leading end margin key 108. In the simulation mode, any kinds of simulations can be performed in addition to a simulation for controlling the development bias in the special document original copy mode. A desired simulation can be selected by operating the up/down keys 103 to input a corresponding simulation number. For example, the up key may be used to input a numeral of the second digit and the down key may be used to input a numeral of the first digit.

After starting the simulation for changing the development bias in the special document original copy mode, the operator (service person) operates the up/down keys 103 to change the setting for the development bias (Step S14). In response thereto, the control section 151 changes the levels of the development bias corresponding to the respective density levels while keeping the gradient of the development bias with respect to the density level unchanged. More specifically, provided that the development bias curve is defined in a graph with the density level as abscissa and the development bias level as ordinate, the development bias curve is moved upward or downward parallel to its original position. The up/down keys 103 correspond to bias shift input means and the control section 151 functions as bias shift means.

Upon completion of the adjustment of the development bias, the test copying operation is performed again (Step S8). This process sequence is repeated until an acceptable test copy is obtained. Then, the process flow goes through Steps S15 and S16, and the density controlling operation is completed. To leave the simulation mode, the up/down keys 103 are operated to input another simulation number, for example.

As described above, in accordance with the present invention, the lowering of the surface potential of the photoreceptor 20 reduces the image density of a high density area in a copy image and moderates the density gradient of the copy image. By selecting a light exposure level for a low image density document original, insufficiency of the image density can be compensated which may otherwise result from the reduction in the surface potential. Further, by adjusting the development bias to a relatively high level at the default density level "4", the fogging of a copy image can be prevented which may otherwise occur when the light exposure level for a low density document original is selected. Thus, a copy which is free from a front trailing and tail trailing and excellent in the image density reproducibility can be made from a document original from which an excellent copy can hardly be obtained by separately controlling the light exposure or the development bias.

Since the image density control is performed such that the gradient of the development bias with respect to the image density is moderated, fine adjustment of the image density can be performed by a user. Therefore, user's preference for different image densities can be accommodated by the fine adjustment. Thus, an excellent copy can be obtained from a document original with a locally nonuniform image density.

Although only one specific preferred embodiment of the present invention has been described in detail, the present invention can, of course, be embodied in different ways. In the embodiment described above, the copying operation for an ordinary document original is performed in the ordinary copy mode defined as a default mode, and the operation mode is switched to the special document copy mode by continuously pressing the density switching key 129 for the predetermined time period. Where the copying operation for a document original including a high density portion and a low density portion is to be frequently performed, however, it may be more preferable for the ease of operation of the copying machine that the special document original copy mode is defined as the default mode.

In the aforesaid embodiment, the surface potential of the photoreceptor 20 is reduced by 100V in the special document original copy mode. The shift amount of the surface potential can be suitably determined depending on the construction of a copying machine to be used. The shift amount is preferably within a range such that the surface potential can be adjusted only by controlling the main high-voltage transformer output circuit 152 by means of the control section 151. This only requires alteration of a relevant program to be executed by the control section 151.

In the aforesaid embodiment, the optical scanning of a document original is achieved by moving the document original in one way with respect to the stationary light source 17. The scanning may otherwise be achieved by moving a light source with respect to a document original placed in a fixed position.

Although the present invention has been described in detail by way of the embodiment thereof, it should be understood that the foregoing disclosure is merely illustrative of the technical principles of the present invention but not limitative of the same. The spirit and scope of the present invention are to be limited only by the appended claims.

What is claimed is:

1. A method for controlling an image density in copying a special document original by a copying machine which is capable of making a copy of an ordinary document original with a relatively small image density variation and a special document original with a relatively large image density variation and which includes a light source for illuminating a document original, a photoreceptor which is to be exposed to light reflected from the document original for formation of an electrostatic latent image on a surface thereof, and a developing unit for developing the electrostatic latent image into a toner image, the method comprising the steps of:

adjusting surface potential of the photoreceptor to a level lower by a predetermined value than that to be employed for an ordinary document original copying operation;

adjusting an amount of light emitted from the light source for illumination of a special document original to a predetermined level adapted for a low image density document original;

adjusting development bias to be applied to the developing unit, in adaptation to at least a predetermined standard density level, to a level higher by a predetermined value than that to be employed for the ordinary document original copying operation;

incorporating density control input means for setting the development bias to be applied to the developing unit to a level adapted for any one of a plurality of density levels including the standard density level for variable adjustment thereof; and determining levels of the development bias corresponding to the respective density levels such that a rate of a change in the development bias with respect to a change in the density level is smaller than that for the ordinary document original copying operation.

2. A method as set forth in claim 1, farther comprising the step of making a test copy of the document original and operating the density control input means in accordance with an image density of a resulting copy for adjustment of the development bias.

3. A method as set forth in claim 1, further comprising the steps of:

incorporating bias shift input means for shifting each level of the development bias corresponding to the respective density levels by an equal bias shift amount; and making a test copy of the document original and operating the bias shift input means to shift each of the levels of the development bias corresponding to the respective density levels by an equal bias shift amount which depends on an image density of a resulting copy.

4. An apparatus for controlling an image density in copying a special document original for use in a copying machine which is capable of making a copy of an ordinary document original with a relatively small image density variation and a special document original with a relatively large image density variation and which includes a light source for illuminating a document original, a photoreceptor which is to be exposed to light reflected from the document original for formation of an electrostatic latent image on a surface thereof, a developing unit for developing the electrostatic latent image into a toner image, and density control input means for setting the development bias to a level adapted for any one of a plurality of density levels including the standard density level for variable adjustment thereof in the developing unit, the apparatus comprising:

surface potential controlling means for adjusting surface potential of the photoreceptor to a level lower by a predetermined value than that to be employed for an ordinary document original copying operation;

light amount controlling means for adjusting an amount of light emitted from the light source for illumination of a special document original to a predetermined level adapted for a low image density document original;

development bias controlling means for adjusting development bias to be applied to the developing unit, in adaptation to at least a predetermined standard density level, to a level higher by a predetermined value than that to be employed for the ordinary document original copying operation; and bias gradient changing means for determining levels of the development bias corresponding to the respective density levels such that a rate of a change in the development bias with respect to a change in the density level is smaller than that for the ordinary document original copying operation.

5. An apparatus as set forth in claim 4, further comprising:

bias shift input means for inputting a bias shift amount on the basis of which levels of the development bias corresponding to the respective density levels are equally shifted; and bias shift means for equally shifting the levels of the development bias corresponding to the respective density levels by the bias shift amount in response to an input from the bias shift input means.

6. A copying machine capable of making a copy of an ordinary document original with a relatively small image density variation and a special document original with a relatively large image density variation, the copying machine comprising:

a light source for illuminating a document original;

a photoreceptor which is to be exposed to light reflected from a document original for formation of an electrostatic latent image on a surface thereof; and a developing unit for developing the electrostatic latent image into a toner image;

mode switching means for switching an operation mode thereof between an ordinary document original copy mode and a special document original copy mode;

surface potential controlling means for, in the special document original copy mode, adjusting surface potential of the photoreceptor to a level lower by a predetermined value than that to be employed for the ordinary document original copy mode; and light amount controlling means for, in the special document original copy mode, adjusting an amount of light emitted from the light source for illumination of a special document original to a predetermined level adapted for a low image density document original.

7. A copying machine as set forth in claim 6, further comprising development bias controlling means for, in the special document original copy mode, adjusting development bias to be applied to the developing unit, in adaptation to at least a predetermined standard density level, to a level higher by a predetermined value than that to be employed for the ordinary document original copy mode.

8. A copying machine as set forth in claim 7, further comprising:

density control input means for setting the development bias to a level adapted for any one of a plurality of density levels including the standard density level for variable adjustment thereof in the developing unit; and bias gradient changing means for, in the special document original copy mode, determining levels of the development bias corresponding to the respective density levels such that a rate of a change in the development bias with respect to a change in the density level is smaller than that in the ordinary document original copy mode.

9. A copying machine as set forth in claim 8, further comprising:

bias shift input means for inputting a bias shift amount on the basis of which levels of the development bias corresponding to the respective density levels are equally shifted; and bias shift means for equally shifting the levels of the development bias corresponding to the respective density levels by the bias shift amount in response to an input from the bias shift input means.

* * * * *